US006298749B1

(12) United States Patent
Stroer et al.

(10) Patent No.: US 6,298,749 B1
(45) Date of Patent: Oct. 9, 2001

(54) JOINTED HAND BRAKE RELEASE HANDLE

(75) Inventors: W. Kurt Stroer, Frankfort; David C. Brabb, Clarendon Hills; Howard Sommerfeld, Oak Forest, all of IL (US)

(73) Assignee: Westinghouse Air Brake Company, Wilmerding, PA (US)

( * ) Notice: Subject to any disclaimer, the term of this patent is extended or adjusted under 35 U.S.C. 154(b) by 0 days.

(21) Appl. No.: 09/061,314

(22) Filed: Apr. 16, 1998

(51) Int. Cl.[7] ..... G05G 1/04
(52) U.S. Cl. ..... 74/524; 74/547
(58) Field of Search ..... 74/523, 524, 525, 74/544, 546, 547

(56) References Cited

U.S. PATENT DOCUMENTS 1,300,384 * 4/1919 Hanahan ..... 74/547
2,281,143 * 4/1942 Dickerson ..... 74/524
2,793,542 * 5/1957 Hirschkorn ..... 74/524 X
3,486,397 * 12/1969 Roock et al. ..... 74/524 X

FOREIGN PATENT DOCUMENTS

476208 * 3/1992 (EP) ..... 74/547

* cited by examiner

*Primary Examiner*—Mary Ann Green
(74) *Attorney, Agent, or Firm*—James Ray & Associates

(57) ABSTRACT

A jointed hand brake release handle for a railway car hand brake mechanism, having a lever arm with an inner end attachable to a rotatable hand brake release post of a hand brake mechanism, and an extension arm pivotally attached to the outer end of the lever arm and adapted for pivotal movement such that a contact face on the inner end of the lever arm can be brought into contact with a contact face on the outer end of the lever arm, and such that continued pivotal movement of the extension arm will cause rotational movement of the lever arm and rotation of the hand brake release post.

16 Claims, 5 Drawing Sheets

JOINTED HAND BRAKE RELEASE HANDLE

CROSS-REFERENCE TO RELATED APPLICATION

This application is related to application Ser. No. 09/061,313, filed on even date herewith, entitled "TWO PIECE HAND BRAKE RELEASE HANDLE", which is assigned to the assignee of the present application, and is incorporated herein by reference.

FIELD OF THE INVENTION

The present invention relates generally to a hand braking apparatus for railway cars and, more particularly, this invention relates to a new, unique and improved hand brake release handle for use with any conventional hand brake mechanism as is normally mounted on a railway car for applying and releasing the hand brake system of the railway car. The new and unique hand brake release handle of this invention is designed so that an essential, elongated portion thereof will hang freely downward from the hand brake mechanism when not in use to thereby prevent it from remaining in a fixed position that may leave it in harms way to unintentionally present a nuisance or hazard to railway personnel and others who could be injured by such a handle extending outwardly.

BACKGROUND OF THE INVENTION

As is generally well known in the railway industry, when railway cars are taken out of a train and parked at a siding or yard, the hand brakes on at least some of these cars are applied as a precaution against unwanted or unexpected movement of the cars. A typical railway car hand brake system normally consists of an apparatus for manually applying and biasing one or more brake shoes against one or more wheels of the railway car by either turning a hand wheel or pumping a ratchet handle on a hand brake mechanism attached to the railway car. The hand brake mechanism is usually either a cast or stamped metal gear housing usually attached to an outside end wall of the railway car and having a rotatable chain drum therein which can be rotated by turning the hand wheel or pumping the ratchet handle on the hand brake mechanism to wind a brake chain onto the chain drum. The other end of the brake chain normally extends through the bottom of the gear housing and is interconnected with cables or other linkage to brake shoes, such that winding of the brake chain onto the chain drum will apply tension to the brake chain and linkage as necessary to draw the interconnected brake shoes against adjacent railway car wheels and, accordingly, apply the hand brake as intended. In view of the fact that the hand brake, when applied, will put the brake chain and linkage in considerable tension, the hand brake mechanism must also include a lock means for locking the chain drum in place when the hand brake has been applied, to thereby maintain the tension in the brake chain and linkage and, accordingly, maintain the hand brake in the applied condition. Such a locking means normally comprises a ratchet wheel and pawl system within the hand brake mechanism to maintain the rotational position of the chain drum. A significant number of different hand brake mechanisms are known in the railway industry, an example of which is disclosed in U.S. Pat. No. 5,127,283, assigned to the assignee of this invention, and is incorporated herein by reference.

Although turning the hand wheel in the opposite direction may operate to release the hand brake in proportion to the extent of such turning, some ratchet wheel and pawl systems may not permit turning the hand wheel in the opposite direction. Accordingly, most hand brake mechanisms are provided with a quick release, non-spin mechanism which functions to instantly and completely release the hand brake without causing the hand wheel or ratchet handle to spin as the lock means on the chain drum is released. Such quick release mechanisms usually function by completely disengaging the chain drum from the lock means and gear mechanism for turning the chain drum. The quick release mechanism is normally activated by pivoting a hand brake release handle, the hand brake release handle being attached to a brake release shaft, which when rotated by the hand brake release handle outside of the gear housing, will disengage the chain drum from the mechanism locking it in place, thereby permitting the chain to self unwind from the chain drum. Normally, the outer end of the brake release shaft is provided with a tight-fitting lever arm type of hand brake release handle so that to release the hand brake, the handle or lever arm is merely pushed upwardly to rotate the brake release shaft (normally clockwise) as necessary to completely release the hand brake.

After the hand brake is released, and the hand brake release handle is released from manual manipulation, ideally, the hand brake release handle should return to its starting position by the force of gravity. However, due to frictional forces within the hand brake mechanism, the hand brake release handle may not return to a start position by the mere force of gravity, but often times will remain extending outwardly from the hand brake mechanism where it was when the brakeman released his grip thereon. If the brake release handle is left in that position extending outwardly from the hand brake mechanism, it can become a nuisance, or worse yet, a serious hazard. In extending outwardly from the hand brake mechanism, it may in some situations extend into the path of the ladder at the end of the railway car, or even extend beyond the edge of the railway car into the path of persons adjacent to the railway car, and thus present a hazard not only to railway personnel but also to pedestrians who may be standing or walking adjacent to such a railway car. Indeed, such a rigid lever arm extending laterally beyond the edge of the railway car would not only be hazardous to personnel, but if the car is in motion, the hazard would be greatly increased, and could even seriously damage railroad structures immediately adjacent to the track upon which such a railroad car is moving, not to mention damage which would result to the railway car itself and the hand brake mechanism attached thereto should such an extending handle strike a fixed object. Reference to FIG. 2 will illustrate one example of a prior art hand brake mechanism whereby the hand brake release handle does extend outwardly as described above.

While the hazard could be eliminated by manually forcing the hand brake release handle back to its starting position after it is utilized to effect a brake release, this often is not done by busy railway personnel, thus being inadvertently left in a position as illustrated in FIG. 2, creating the above said nuisance and/or hazard. Accordingly, what is needed is a hand brake release handle which cannot remain disposed in such a nuisance or hazardous position, but rather will return automatically to its starting position without relying on railway personnel. While the hazard could automatically be eliminated by making the brake release handle or lever arm significantly shorter so that it cannot extend outwardly by a sufficient length to be a nuisance or hazard, this would obviously also increase the moment force or torque required to effect a brake release, and could even make it impossible to effect a brake release without superhuman strength. It has also been realized that some sort of a ratcheting system could be developed for the hand brake release handle or release mechanism to eliminate the above-noted nuisance and hazards, but obviously such a ratcheting system would even further complicate the already complicated hand brake mechanism, which already includes at least one ratcheting system, and would add significantly to the cost of such a hand brake mechanism. Furthermore, such a ratcheting system would also include frictional forces therein, and would not necessarily eliminate the hazards of an outwardly extending handle or lever arm, without still requiring concerted effort by railroad personnel to assure its proper functioning and return to the starting position.

SUMMARY OF THE INVENTION

This invention is predicated on the conception and development of a new, unique and exceptionally low-cost hand brake release handle or lever arm for a hand brake mechanism which eliminates the above-said nuisance and hazard by providing an exceptionally simple, jointed hand brake release handle, the outer end of which cannot come to rest at a location where it can be a nuisance or a hazard. The simple and unique hand brake release handle of this invention does not normally require any modification of any existing hand brake mechanism to which it may be attached and can, accordingly, replace any existing prior art hand brake release handle, to be attachable to, and incorporated with, any presently existing hand brake mechanism to thereby eliminate the above-said nuisance and hazards.

In essence, the inventive hand brake release handle of this invention simply comprises a jointed handle, specifically, a relatively short length lever arm portion, such that the length of this shorter lever arm portion will not present a nuisance or hazard as described above no matter what its rotationally orientation may be, and further includes a lever arm extension hingedly attached at the outer end of the short length lever arm, such that the lever arm extension can be pivoted to a rigid abutting engagement with the outer end of the short length lever arm. Accordingly, upward pivotal movement of the extension arm will cause it to abut against the outer end of the short lever arm which will, in essence, effect a single, jointed lever arm comprising both the lever arm and the extension arm thereby providing sufficient leverage to permit easy rotation of the hand brake release post. Upon manual release of the extension arm, however, the force of gravity will cause the extension arm to pivot at the hinged joint to hang downwardly in an out-of-the-way position regardless of whatever position the short lever arm may occupy.

Stated in another way, a more or less conventional length hand brake release handle is provided which is hinged at approximately mid-length, such that when the handle is not in use for purposes of releasing the hand brake, that portion extending outwardly of the hinged joint will hang downwardly in an out-of-the-way position as a result of gravitational forces that cannot be in a position where it will be a nuisance or hazard. The hanging outer portion, however, is adapted for pivotal manual movement at the hinge for pivotal movement into engagement with the non-pivoted portion, so that when so pivoted, the two portions effect a single, jointed handle which in combination has a length comparable to that of such prior art brake release handles, and thus jointly, the combination will be able to provide the same leverage as the prior art release handle, and capable of turning the brake release post with the same leverage.

OBJECTS OF THE INVENTION

It is, therefore, one of the primary objects of the present invention to provide a new and improved hand brake release handle for a hand brake mechanism on a railway car in which an elongated handle or portion thereof cannot be left in a position where it becomes a nuisance or a hazard to persons adjacent to the railway car.

Another primary object of the present invention is to provide a new and improved, yet simple and low-cost, hand brake release handle for a hand brake mechanism on a railway car in which an elongated handle or portion thereof cannot extend outwardly from the hand brake mechanism to become a nuisance or a hazard to persons adjacent to the railway car.

A further primary object of this invention is to provide a new and improved hand brake release handle for a hand brake mechanism on a railway car which in its at-rest position will not extend outwardly from the hand brake mechanism to become a nuisance to railway personnel or a hazard to persons adjacent to the railway car, and which can readily and easily be retro-fitted onto any existing hand brake mechanism.

Still another object of this invention is to provide a hand brake mechanism having a new and improved, yet simple and low-cost, hand brake release handle which in its at-rest position will not extend outwardly from the hand brake mechanism to become a nuisance to railway personnel or a hazard to persons adjacent to the railway car.

In addition to the various objects and advantages of the invention described above, a number of additional objects and advantages of the hand brake release handle of the present invention will become more readily apparent to those persons skilled in the railway braking art from the following more detailed description of the invention, particularly, when such description is taken in conjunction with the attached drawings and the appended claims.

DESCRIPTION OF THE PREFERRED EMBODIMENT OF THE INVENTION

Figure 1:
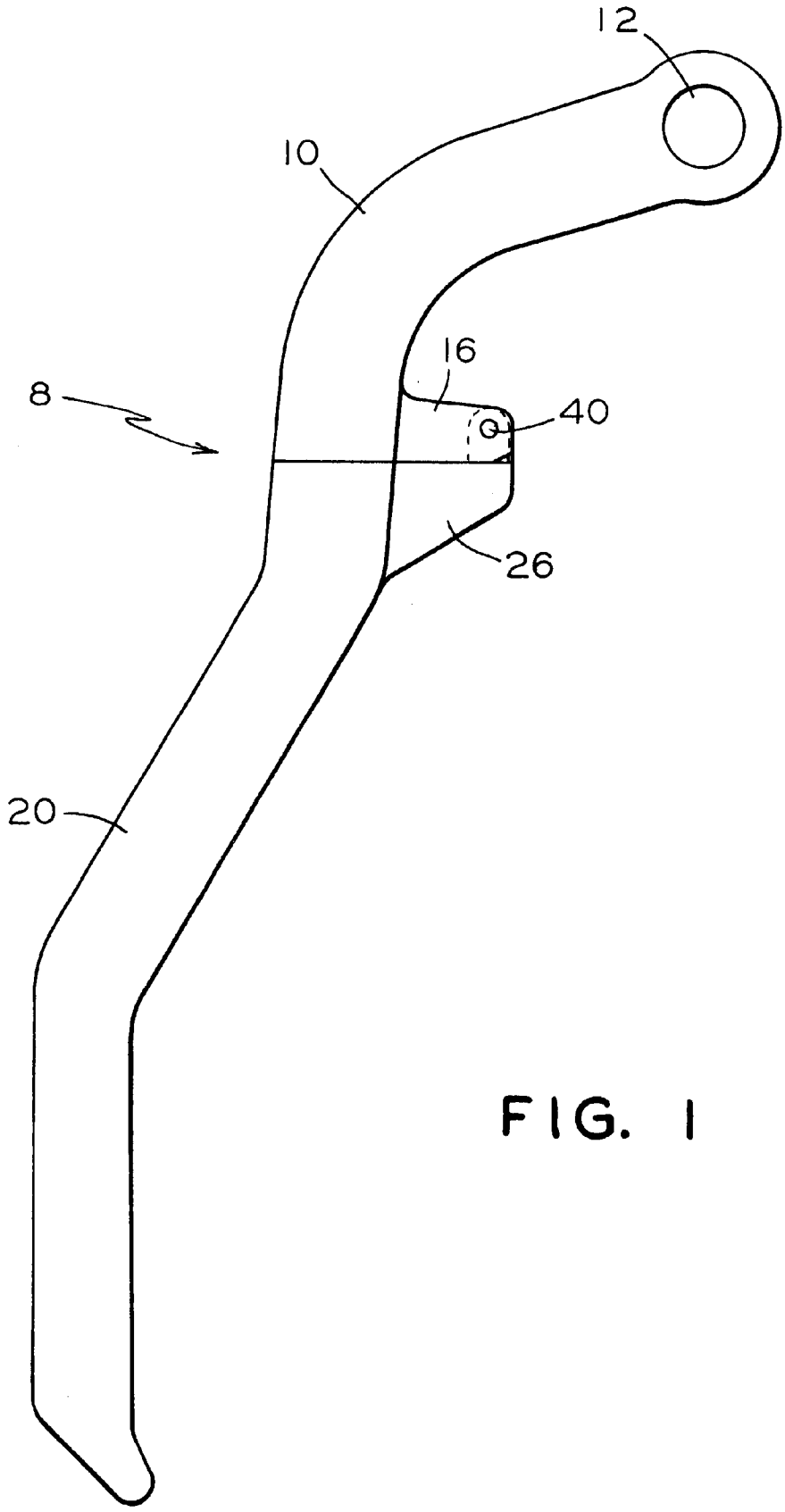
FIG. 1 is a plan view of a presently preferred embodiment of the unique and inventive hand brake release handle of this invention.
Figure 3:
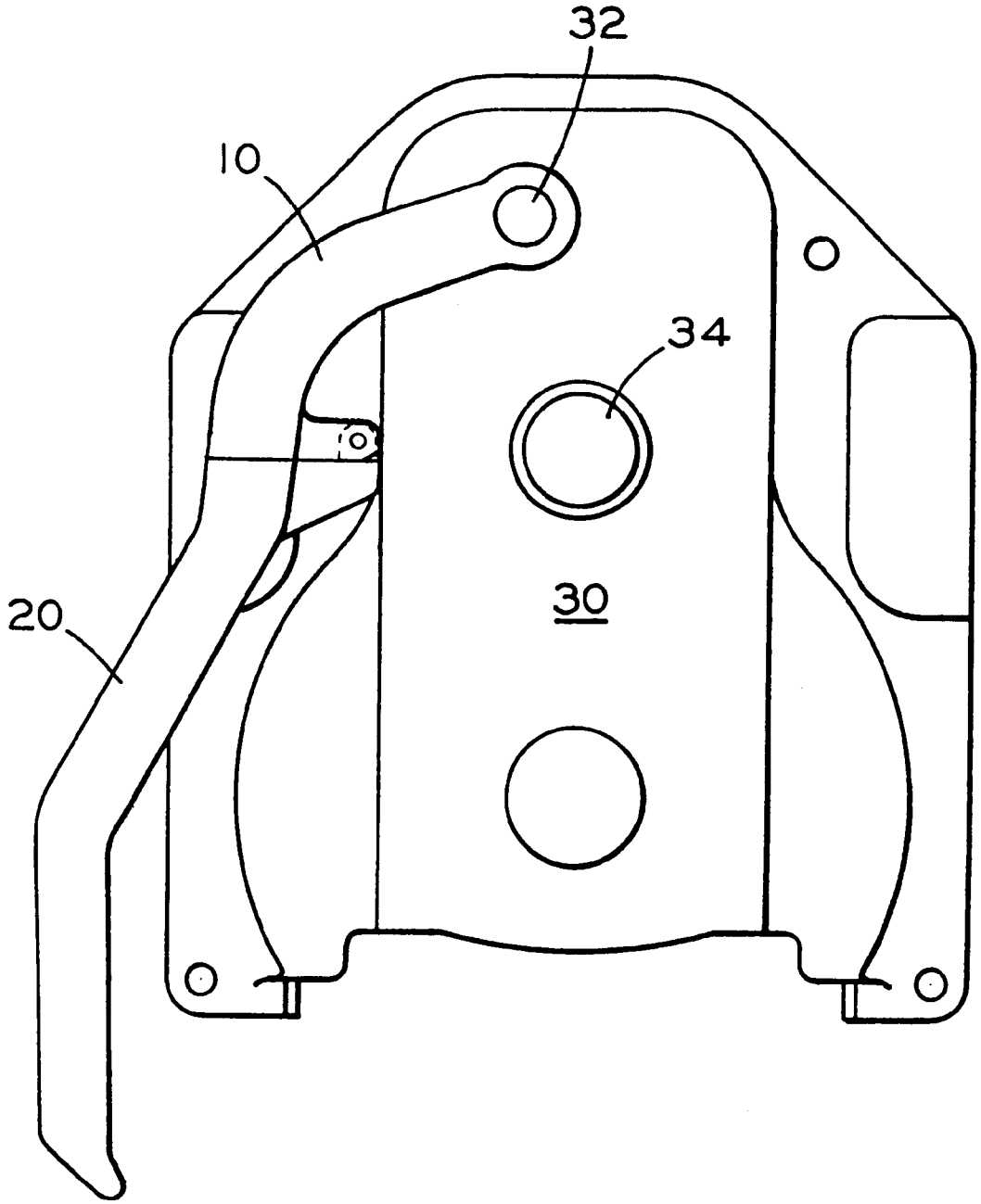
FIG. 3 is substantially the same as FIG. 2, except that the inventive hand brake release handle shown in FIG. 1 is substituted for the prior art hand brake release handle shown in FIG. 2, and the handle is disposed in the starting position.
Figure 4:
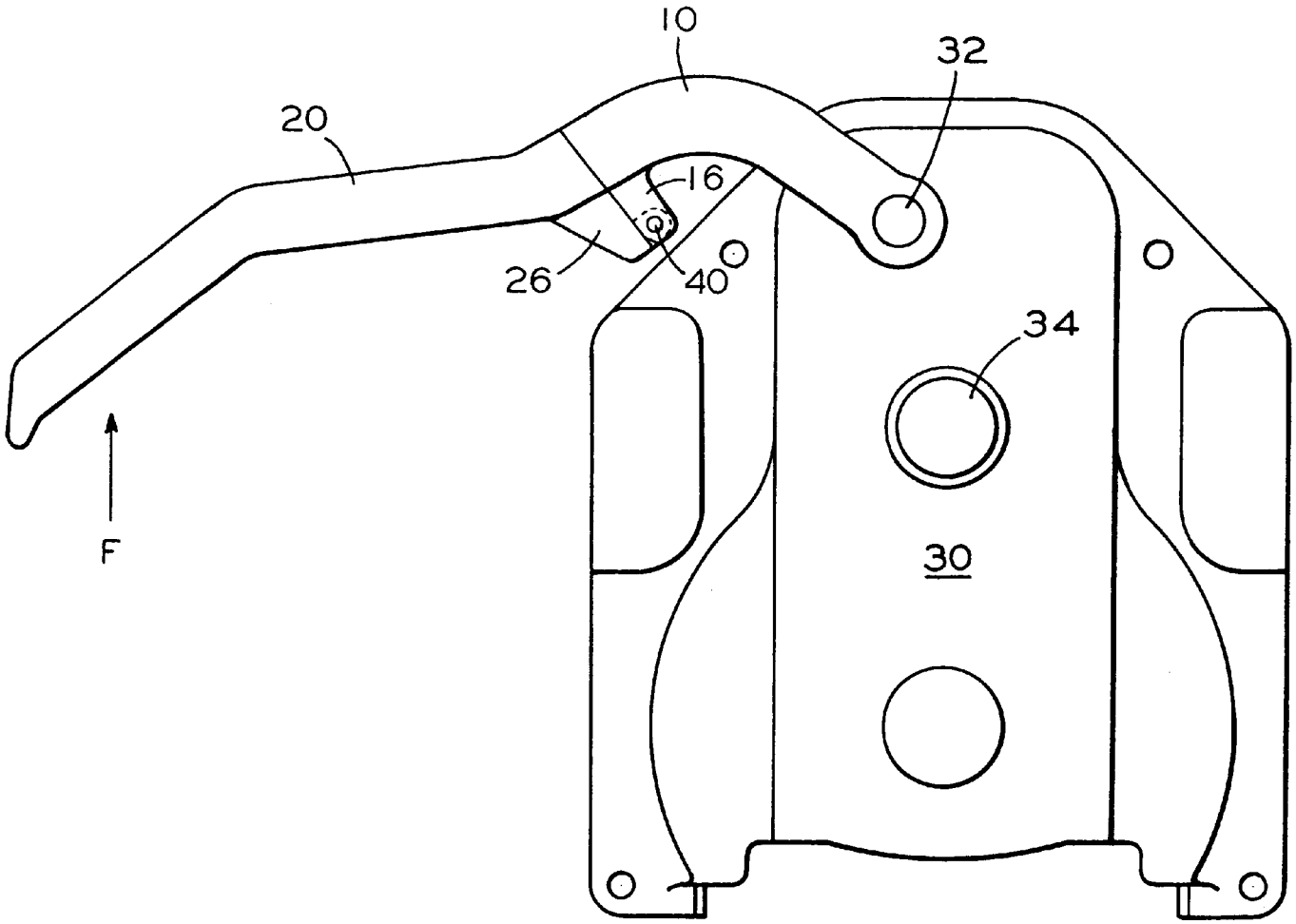
FIG. 4 is substantially the same as FIG. 3 except that the handle is disposed in the hand brake release position.

With reference to the attached drawings, and more particularly, to FIGS. 1, 3–4, a presently preferred embodiment of the inventive hand brake release handle is depicted. As shown, the inventive hand brake release handle, generally designated 8, essentially comprises two lever arm portions, namely, a lever arm 10 having a aperture 12 at a first end, and an extension arm 20, a first end of which is hingedly or pivotally attached to a second end of lever arm 10. The aperture 12 on lever arm 10 is adapted to be tightly fitted onto a rotatable brake release post 32 extending forwardly from a hand brake mechanism 30 (FIGS. 3 and 4), such that manual rotation of lever arm 10 (clockwise as illustrated) will cause rotation of the brake release post 32 and, accordingly release of the hand brake. Lever arm 10 further includes a first contact surface 14, at its second end, at least a portion of which is transverse to the axis of the lever arm 10, while extension arm 20 includes a second contact surface 24 at its upper end adjacent to lever arm 10, at least a portion of which is transverse to the axis of extension arm 20 (See FIG. 5). The hinged attachment between lever arm 10 and extension arm 20 is effected by providing at least one flange extending outwardly from each of lever arm 10 and extension arm 20; e.g., flange 16 extending from lever arm 10, and flange 26 extending from extension arm 20, which outer ends overlap sufficiently to be joined by a hinge pin 40. Contact surface 14 on lever arm 10, and contact surface 24 on extension 20 are configured so that they are adapted to abut against each other when extension arm 20 is hingedly pivoted in a first direction (clockwise as shown) until such abutment is effected, (as depicted in FIGS. 1 and 3), while pivotal movement in the opposite or a second direction (counter clockwise) will cause contact surfaces 14 and 24 to separate as extension arm 20 pivots away from lever arm 10 about hinge pin 40 (as depicted in FIG. 4).

While aperture 12 on lever arm 10 is shown to be circular, aperture 12 can have any desired configuration as long as it is capable of being rigidly secured to brake release post 32 to assure that upward pivotal movement of lever arm 10 will effectively rotate brake release post 32 sufficiently to achieve a quick release of the railway car's hand brake system. Accordingly, the relationship of lever arm 10 to the brake release post 32 is substantially the same as the prior art relationship between the prior art brake release handle and the brake release post 32, so that upward pivotal movement of lever arm 10 will effect the desired hand brake release.

While the nature of abutting contact surfaces 14 and 24, on lever arm 10 and extension arm 20, respectively, are not particularly critical, they should be so shaped, configured and spaced from hinge pin 40, that by pivoting lever arm 10, clockwise (as shown) about hinge pin 40, will cause contact surface 24 on extension arm 20 to be abutted against contact surface 14 on lever arm 10.

Figure 2:
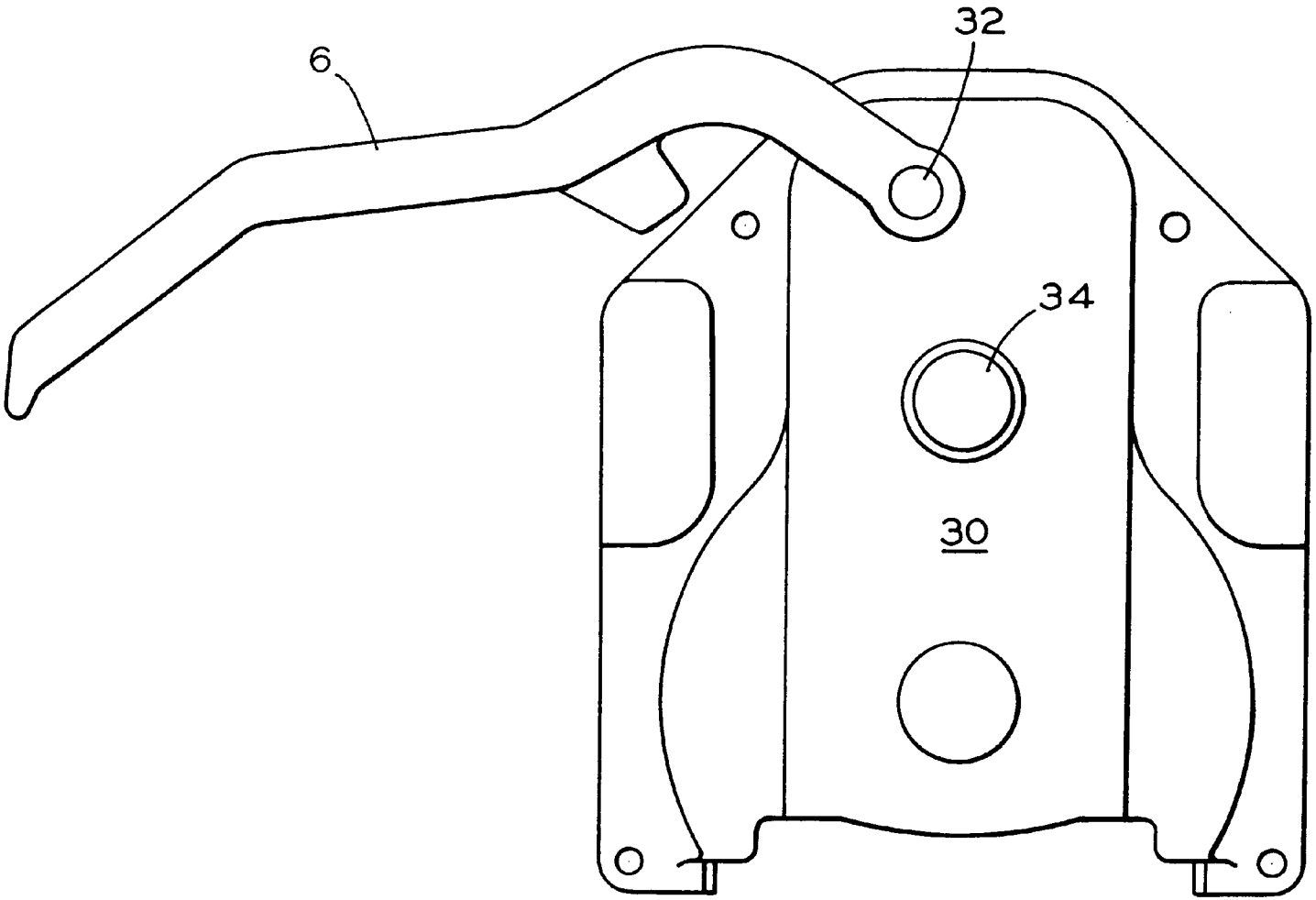
FIG. 2 PRIOR ART
FIG. 2 is a front view of a currently existing hand brake mechanism having a conventional prior art hand brake release handle as it may be disposed in a nuisance or hazardous position as described above, and is accordingly labeled "Prior Art"

As shown in FIG. 2, the prior art hand brake release handle, as shown therein, is provided with a stop flange 6 which is adapted to abut against the side of the hand brake mechanism when the handle is in the starting position to thereby space the handle sufficiently outward to permit one to easily grasp hold of its outer end. In contrast thereto, it will be noted that in the illustrated embodiment of this invention, as shown in FIGS. 1 and 3–4, the flanges 16 and 26, pinned together with hinge pin 40, are positioned to take the place of such a stop flange 6. While such an arrangement is not essential for the purposes of this invention, this arrangement does permit the hinged flanges 16 and 26 to serve a dual purpose, and in essence simplifies the structure for those situations where such a stop flange is desired.

Figure 5:
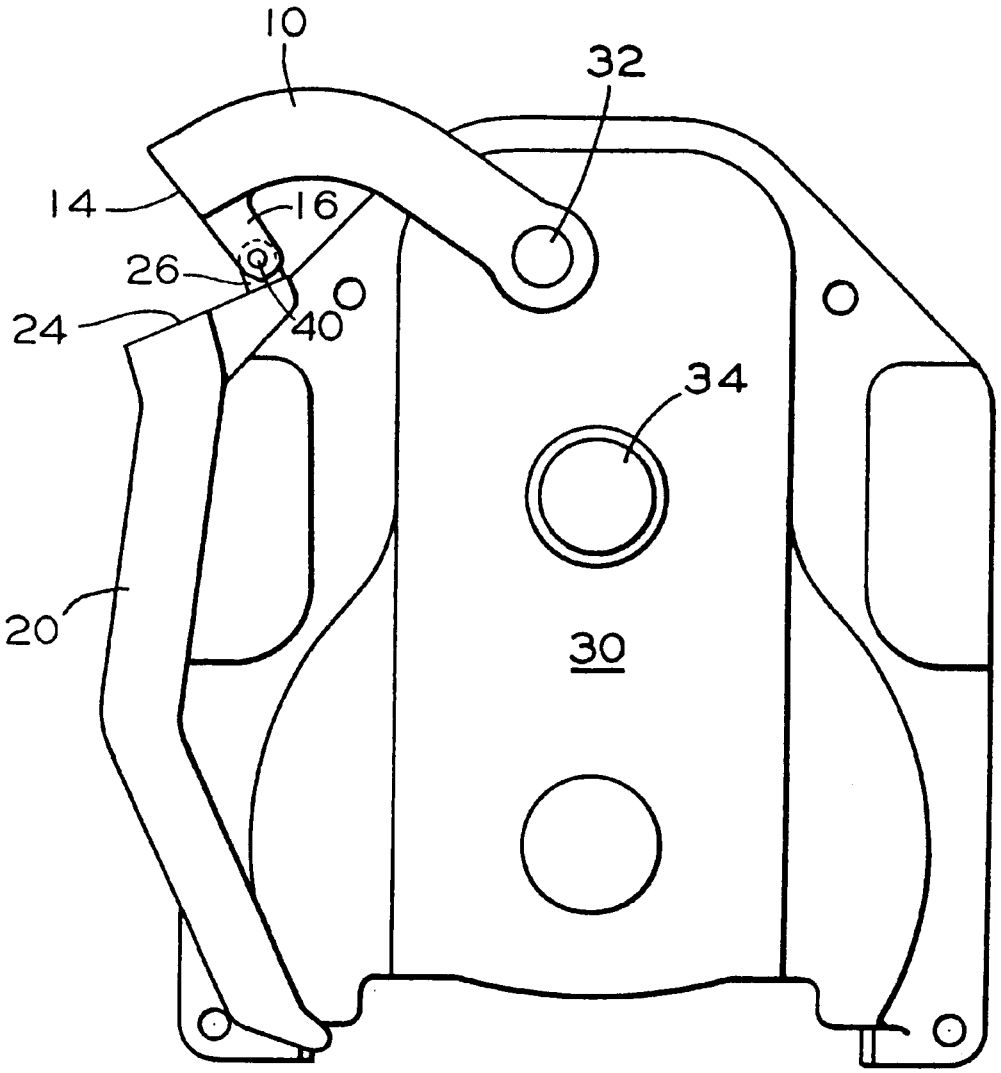
FIG. 5 is substantially the same as FIGS. 3 and 4 except that the upper portion of the handle has been rotated to the hand brake release position and left in that position after the lower portion of the handle has been released from manual manipulation, and allowed to be pivoted downwardly by the force of gravity.

The operation and inventive function of the hand brake release handle of this invention can be seen by examining FIGS. 3, 4 and 5 in sequence, where in the inactivated position and starting position, as shown in FIG. 3, the hand brake release handle 8 of this invention will extend downwardly in a position where release handle 8 can be manually grasped and lifted to thereby rotate it clockwise to activate the hand brake release by rotating the hand brake release post 32. When the hand brake release has been effected, the hand brake release handle 8 will be disposed as shown in FIG. 4. When the brakeman releases his grip on the handle 8, it may return to the starting position as shown in FIG. 3, or in the alternative, frictional forces within the hand brake release mechanism 30 may prevent lever arm 10 from falling to the starting position as illustrated in FIG. 3. In that event, the force of gravity will, nevertheless, cause extension arm 20 to pivot at pin 40 to virtually drop to a position as illustrated in FIG. 5, where at least that portion, namely lever arm 10, does not protrude outwardly to be a nuisance or hazard. Accordingly, the overall advantage of this invention can be seen by contrasting FIG. 2 with FIG. 5.

Ideally, of course, the overall length of release handle 8, being the combined length of lever arm 10 and extension arm 20, should be comparable to the length of any prior art hand brake release handle it is intended to replace, so that one should be able to achieve whatever torque or leverage is required to effect a complete hand brake release. To minimize the probability of lever arm 10 extending outwardly as shown in FIG. 5 by a length that could still become a nuisance or hazard, it is preferable that lever arm 10 be the shorter element as compared to extension arm 20. As shown, extension arm 20 is approximately three-times the length of lever arm 10, which is perhaps an ideal situation.

It will also be noted that lever arm 10 is somewhat "S" shaped in form. This specific form or configuration, although not critical, is a form specifically designed to be utilized with the hand brake mechanism 30 as illustrated in FIGS. 2–5, so that the outer end of extension arm 20 will extend downwardly adjacent to the hand wheel (not shown) where it can readily be grasped when a brake release must be made. As further shown in FIG. 2, the same "S" configuration was utilized in the prior art hand brake release handle 6, as shown in FIG. 2.

To operate the railway car hand brake one must first apply the hand brake by turning the hand wheel (not shown) which is fixedly attached to a shaft 34. This will serve to wind the brake chain (not shown) onto the brake drum (not shown) and set the hand brake as described above. When it becomes necessary to release the hand brake, one must merely grasp the lower end of extension arm 20, which would be extending below the lower left-hand side of the hand wheel (not shown), and then lift or pivot extension arm 20 upwardly in a clockwise direction. If contact surfaces 14 and 24 are not already in an abutting relationship, such a movement of extension arm 20 will cause it to rotate at pin 40 until such abutting relationship is effected and, thereafter, continued clockwise lifting of extension arm 20 will cause rotation of lever arm 10 therewith, until the hand brake release is effected. When extension arm 20 is thereafter released, the hand brake release handle 8 will return to a position as depicted in either of FIGS. 3 or 4.

Having described in detail a presently preferred embodiment of this invention, it should be apparent that other embodiments could be utilized and modifications incorporated without departing from the spirit of the invention. As a first example, it has already been noted that a number of differing configurations could be utilized for aperture 12, as long as aperture 12 is adapted to be secured to the end of hand brake release post 32 sufficient to rotate the post 32. The overall configuration can also vary considerably depending upon the hand brake release mechanism 30 to which it will be attached. Also, the placement and configuration of contact surfaces 14 and 24 are not particularly critical. While flat abutting surfaces perpendicular to the axes have been depicted in the figures, clearly other configuration can be utilized, provided that they be adapted to abut each other when extension arm 20 is rotated at hinge pin 40. In a like manner, the pinned flanges 16 and 26 can be provided in a variety of different forms and shapes. While the flanges 16 and 26 depicted in the drawings are designed to replace a stop flange 6 of a comparable prior art release handle 6, certainly other configuration and placement would work as well. Obviously, therefore, numerous other modifications and differing embodiments could be utilized without departing from the spirit of this invention.

What is claimed is:

1. A jointed hand brake release handle for attachment to a hand brake release post of a hand brake mechanism, said jointed hand brake release handle comprising; a lever arm having an extension arm hingedly attached to an outer end thereof, said lever arm having an inner end opposite said outer end attachable to such hand brake release post, said extension arm adapted to be pivoted at the hinged attachment such that said extension arm can be pivoted into contact with said lever arm, and such that continued pivotal movement of said extension arm in a first direction will cause rotational movement of both said lever arm and said extension arm a sufficient amount capable of rotating such hand brake release post to effect a hand brake release, said extension arm capable of automatically pivoting about said hinged attachment in a second direction upon release thereof causing said extension arm to hang downwardly in an out-of-the-way position.

2. A jointed hand brake release handle for attachment to a hand brake release post of a hand brake mechanism, according to claim 1, wherein said extension arm is capable of pivoting about said hinged attachment in said second direction due to gravitational force.

3. A jointed hand brake release handle for attachment to a hand brake release post of a hand brake mechanism, according to claim 1, in which said extension arm has a length of approximately three-times the length of said lever arm.

4. A jointed hand brake release handle for attachment to a hand brake release post of a hand brake mechanism, according to claim 1, in which a pivotal attachment for hingedly attaching said extension arm to said lever arm comprises at least one flange member on each of said lever arm and said extension arm, adapted to extend inwardly toward such hand brake mechanism, with the ends of said flange members overlapping sufficiently to be joined by a hinge pin.

5. A jointed hand brake release handle for attachment to a hand brake release post of a hand brake mechanism, according to claim 4, in which said flange members jointly form a spacer extending from said jointed hand brake release handle, said spacer adapted to abut against a side surface of such hand brake mechanism to place said extension arm in an easy to reach position.

6. A jointed hand brake release handle for attachment to a hand brake release post of a hand brake mechanism, according to claim 1, in which said lever arm is provided with an aperture at said inner end adapted to be rigidly fitted onto such rotatable hand brake release post.

7. A jointed hand brake release handle for a railway car hand brake mechanism, said jointed hand brake release handle comprising:

(a) a lever arm having a first end attachable to a rotatable hand brake release post extending from such hand brake mechanism and adapted for pivotal, rotational movement on an axis of such rotatable hand brake release post for turning such rotatable hand brake release post to a hand brake release position;

(b) an extension arm pivotally attached to a second end of said lever arm and adapted for pivotal movement at said second end of said lever arm to a point where a first end of said extension arm abuts against said second end of said lever arm, and such that continued pivotal movement of said extension arm in a first direction will cause rotational movement of said lever arm an amount capable of rotating such hand brake release post, said extension arm being capable of automatically pivoting in a second direction upon release of said extension arm causing said extension arm to hang downwardly in an out-of-the-way position.

8. A jointed hand brake release handle for a railway car hand brake mechanism, according to claim 7, wherein said extension arm is capable of pivoting in said second direction due to gravitational force.

9. A jointed hand brake release handle for a railway car hand brake mechanism, according to claim 7, in which said extension arm has a length of approximately three-times the length of said lever arm.

10. A jointed hand brake release handle for a railway car hand brake mechanism, according to claim 7, in which a pivotal attachment for pivotally attaching said extension arm to said lever arm comprises at least one flange member on each of said lever arm and said extension arm, adapted to extend inwardly toward such hand brake mechanism, with the ends of said flange members overlapping sufficiently to be joined by a hinge pin.

11. A jointed hand brake release handle for a railway car hand brake mechanism, according to claim 10, in which said flange members jointly form a spacer extending from said jointed hand brake release handle adapted to abut against a side surface of such hand brake mechanism to place said extension arm in an easy to reach position.

12. A jointed hand brake release handle for a railway car hand brake mechanism, according to claim 7, in which said lever arm is provided with an aperture at said first end adapted to be rigidly fitted onto such rotatable hand brake release post.

13. A jointed hand brake release handle for a railway car hand brake mechanism, said jointed hand brake release handle comprising:

(a) a lever arm having an aperture at a first end, said aperture adapted to be tightly fitted onto a rotatable brake release post such that rotation of said lever arm will cause rotation of said rotatable brake release post as necessary to effect a hand brake release within such hand brake mechanism, and (b) an extension arm having a first end pivotally attached to a second end of said lever arm and adapted for pivotal movement at said second end of said lever arm to a point where said first end of said extension arm abuts against said second end of said lever arm to effect a jointed lever arm of said lever arm and said extension arm, such that continued pivotal movement of said extension arm in a first direction will cause rotational movement of said jointed lever arm and rotation of said hand brake release post, said extension arm being capable of automatically pivoting in a second direction upon release of said extension arm causing said extension arm to hang downwardly in an out-of-the-way position.

14. A jointed hand brake release handle for a railway car hand brake mechanism, according to claim 13, wherein said extension arm is capable of pivoting about said pivotal attachment in said second direction due to gravitational force.

15. A jointed hand brake release handle for a railway car hand brake mechanism, according to claim 13, in which said extension arm has a length of approximately three-times the length of said lever arm.

16. A jointed hand brake release handle for a railway car hand brake mechanism, according to claim 13, in which the pivotal attachment between said lever arm and said extension arm is effected by providing a laterally extending flange from each of said lever arm and said extension arm, the ends of said laterally extending flanges sufficiently overlapping to be joined by a hinge pin.

* * * * *